United States Patent [19]

Feichtner et al.

[11] 4,410,355

[45] Oct. 18, 1983

[54] PROCESS FOR CONTROLLING A PELLETIZING PLANT FOR FINE-GRAINED ORES

[75] Inventors: Hanns E. Feichtner; Johann Haslmayr; Christian Jaquemar, all of Linz; Friedrich Hoislbauer, Neuhofen a/d Krems; Friedrich Rappold; Franz Feigl, both of Linz, all of Austria

[73] Assignee: Voest-Alpine Aktiengesellschaft, Vienna, Austria

[21] Appl. No.: 204,377

[22] Filed: Nov. 5, 1980

[30] Foreign Application Priority Data

Nov. 6, 1979 [AT] Austria ..... 7139/79

[51] Int. Cl.[3] ..... C22B 1/20

[52] U.S. Cl. ..... 75/5; 266/80; 266/84; 266/89

[58] Field of Search ..... 75/3–5; 266/80, 82, 83, 84, 89

[56] References Cited

U.S. PATENT DOCUMENTS 3,153,587 10/1964 Schuerger ..... 75/5
3,249,422 5/1966 Sironi et al. ..... 75/5

FOREIGN PATENT DOCUMENTS 1153782 9/1963 Fed. Rep. of Germany ..... 75/5
51-22882 7/1976 Japan ..... 75/5

OTHER PUBLICATIONS

Boll, D. F., et al., *Agglomeration of Iron Ores;* Am. Ekevier Pub. Co., Inc., N.Y., pp. 216–221, 80–82, (1973).

*Primary Examiner*—Michael L. Lewis
*Attorney, Agent, or Firm*—Cushman, Darby & Cushman

[57] ABSTRACT

Process for monitoring a pelletizing plant for fine-grained ores, in which the humidity content of the green pellets is adjusted by adding water with consideration of the humidity content of the fine ores and humidified ores, together with optional additives, are hardened on a travelling grate by a heat treatment, characterized in that the green pellets are charged onto the travelling grate and the permeability and optionally also the humidity of the pellet layer is measured, in that the measured values for the permeability and the measured values or the preselected value for the humdity of the green pellets are supplied to a process calculator for monitoring the process on the basis of parameters, such as the process gas temperature, the process gas pressure, the travelling speed of the travelling grate and the amount of charge supplied, preadjusted or defined at the begin of the process, and in that the process is monitored by comparing the value for the position of the sintering point on the travelling grate at the end of the sintering zone, as calculated on basis of these parameters, with a nominal value for this position of the sintering point.

6 Claims, 3 Drawing Figures

PROCESS FOR CONTROLLING A PELLETIZING PLANT FOR FINE-GRAINED ORES

Figure 1:
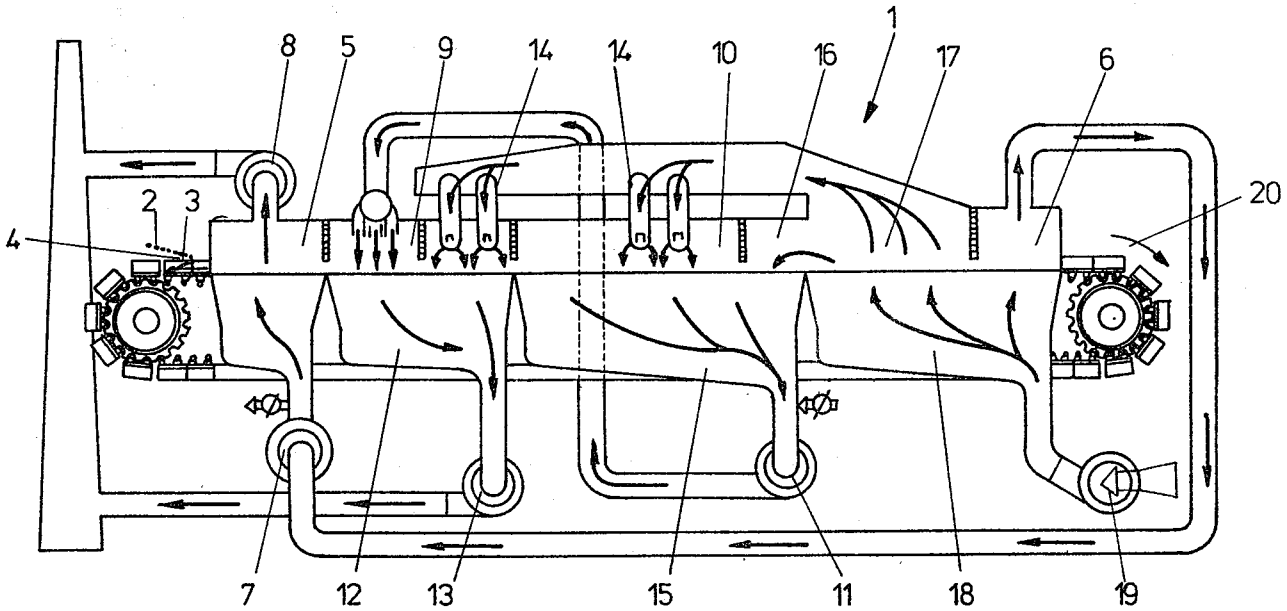

The present invention refers to a process for controlling a pelletizing plant for fine-grained ores, in which the humidity content of the green pellets is adjusted by adding water with consideration of the humidity content of the fine ores and the humidified ores, together with optional additives, are hardened on a travelling grate by a heat treatment. Fine-grained ores must, as a rule, be brought into the form of lumps before further processing. This is necessary above all if the fine-grained ores have a particle size below 0.2 mm. Sintering processes and pelletizing processes have become known for transferring such fine-grained ores into lumps. Pelletizing of fine-grained ores has proved particularly advantageous for various purposes. There are known pelletizing plants in which the process is monitored by a plurality of usual control circuits. A pelletizing plant comprises, as a rule a device for producing green pellets in which pelletizing drums or pelletizing dishes can be used. The green pellets obtained have a very low mechanical strength and must, therefore, subsequently be hardened, for which purpose travelling grates are used. The green pellets are charged on such travelling grates and the travelling grates are then passing a series of different zones for which are given examples in the following. A pressurized drying zone, in which hot air is blown through the grate and the pellet layer thereon, the air, as a rule, being supplied from below the grate. Within this zone, the air temperature is, as a rule, selected within the range of 200° to 280° C. and the air velocity is selected with approximately 2.8 m/s (meters per second). As a rule, there is following a suction drying zone within which air is passed through the grate in opposite direction for completely drying the pellets over the total height of the layer of pellets. The sintering zone is, as a rule, subdivided into a presintering zone, a sintering zone per se and a post-sintering zone, the three zones differing one from the other primarily by the temperatures maintained therein. The temperatures usually maintained within the sintering zone are in dependence on the ore used usually maintained within the range of 1300° to 1350° C., noting that for hematite pellets only the amount of heat required for heating the pellets must be considered whereas for magnetite pellets the heat of oxydation generated must additionally be considered. As a rule there is following a cooling zone in which the pellets can be cooled down to an average temperature of, for example, 120° C. With the known processes for controlling such pelletizing plants, there is controlled, for example, the travelling velocity of the grate in dependence on the amount of pellets supplied such that the height of the layer of pellets is maintained constant. The temperatures of the gasses entering the layer of pellets are adjusted to a predetermined fixed value, the temperature of the entering cooling air being, as a rule, ambient temperature. The amounts of gasses are adjusted for the pressurized drying zone and for the cooling zone by preselecting a definite blast box pressure and for the suction drying zone controlled by a preselected blast box temperature, the gasses for the suction drying zone being, as a rule, heated by the effluent gasses of the sintering zone. Such monitoring processes can not take into consideration the properties and the composition, respectively, of the charge and provide, as a rule, only a correction tending in a certain direction and becoming effective only with some delay in view of the delayed heat transmission from the gasses to the pellets. With such control processes, the operating conditions can scarcely be optimized with respect to the throughput and the energy consumption. Furthermore such plants can only with great difficulties be started after a shut-down of the plant and it is extremely difficult to establish steady operating conditions when the properties of the charge are changed.

It is an object of the present invention to avoid the drawbacks of the known control processes and to provide a monitoring process of the initially mentioned type in which all parameters required for operating the plant are defined already at the beginning of operation and can be made use of by a process-oriented calculator or computer. For solving this task, the invention essentially consists in that the green pellets are charged onto the travelling grate and the permeability and optionally also the humidity of the pellet layer is measured, in that the measured values for the permeability and the measured values or the preadjusted value for the humidity of the green pellets are supplied to a process calculator for monitoring the process on the basis of parameters, such as for example the process gas pressure, the process gas temperature, the travelling speed of the travelling grate and the amount of charge supplied, preadjusted or defined at the begin of the process, and in that the process is monitored by comparing the value for the position of the sintering point on the travelling grate at the end of the sintering zone, as calculated on basis of these parameters, with a nominal value for this position of the sintering point. In contrast to the known control processes, all required adjustments are with this monitoring process already made at the begin of supplying the charge and any idle time or dead time is avoided as is encountered with the usual control processes. The parameter to be influenced in the inventive monitoring process is the position of the sintering point, which position is calculated on the basis of the parameters preselected or defined at the begin of the process and is optimized by iteration of the calculating process with variation of various parameters such that the calculated value for the position of the sintering point coincides with a nominal value, according to which the sintering point is located at the end of the sintering zone. This means simultaneously that such a position of the sintering point results in the most favourable efficiency of the pelletizing plant. The only quantity or value being derived for subsequent charges of the process itself is the permeability of the layer of pellets on the travelling grate. The permeability can be derived either from the characteristic curve of the blower for the pressurized drying zone or from the characteristic curve of a pre-connected blower and making use of the position of the drift plates, of the pressure increase and of the gas temperature or from the measured values for the pressure and the amount of gas in the existing or the pre-connected suction box. Within the process calculator, an expected drying rate and an expected sintering point is calculated on the basis of a model by means of the disturbance variables humidity and permeability and other easily accessible or measurable parameters such as process gas pressure, process gas temperature, travelling speed of the travelling grate and amount of charge supplied. This pre-calculated actual value is by calculation compared with the nominal value for the position of the sintering point and from this backward calculation result the values required at the begin of the process for changing the pressures, the temperatures or the amounts such that the actual position, to be expected, of the sintering point coincides with the nominal position. Thus, all influencing quantities are already defined immediately after charging the material on the travelling grate and an effective feed forward control is relized which is free of any idle times and with which the process can be optimized with respect to energy consumption and throughput of materials.

For such an effective feed forward control or monitoring process it is necessary to substitute the cascade control of the blowers for the suction drying zone, the preheating zone and the blast box recuperative zone as is used with known processes by control circuits of short response time. Of course, control circuits can be provided in a plant for performing the inventive monitoring processes for maintaining the operational parameter in consideration relative to the determined and monitored nominal value.

Preferably the process according to the invention is performed such that the position of the sintering point is monitored by varying the process gas pressure and the sintering temperature selected according to the properties of the fine ore is maintained constant. In this manner, a nominal value for the process gas pressure is preselected and this nominal value can be maintained with a simple control equipment and in view of only the process gas pressure being monitored the optimum sintering temperature can be maintained for a definite charge.

The height of the layer of pellets can be maintained constant in the inventive monitoring process by varying the travelling speed of the travelling grate in a manner known per se.

Control of the amount of gas flow for the suction drying zone and for the heating zones is preferably effected by preselecting a nominal value for the blast box pressure according to which nominal value the associated waste gas blower is controlled. Such a control can more precisely be adapted to the existing requirements as is the case with known controls influencing the temperature. With a control influencing the temperature, there results always a dead time or idle time on ground of the heat transfer time intervals. Furthermore, temperature control is, as a rule, acting with a lower speed than control of the blast box pressure.

Control of the blastboxes for the sintering zone can be effected in an analogous manner, control of the amount of gas flow being effected by preselecting a nominal value for the blast box pressure in dependence on which the recuperative blower associated to the sintering zone is controlled.

In case the calculator demands an increase or a reduction of the pressure such that the preselected limits are surpassed, which means that the control valves are completely open or closed, the nominal values for the gas temperatures at the entrance of the charge are, within pre-established limits, introduced into the calculation with a correspondingly high or low value such that the nominal temperature at the sintering point coincides with the calculated temperature.

The temperature limits within the drying zones result in this case from the maximum admissible temperature load of the blowers and from the maximum admissible heat stress of the green pellets within these zones because the green pellets might burst on too high a heat supply. This means that within each of these zones the critical drying speed of the pellets need not be surpassed in any point of the layer of pellets.

If by varying the gas entering temperatures in the mentioned manner, the calculated temperatures at the sintering point are not in accordance with the preselected nominal value, the amount of green pellets supplied can be reduced or increased, respectively.

It is also possible to determine under which pressures and temperatures prevailing at the downstream location of the layer of pellets supplied, the electrical energy, the heat energy or total energy becomes a minimum in dependence on the throughput of pellets. This provides the possibility to change the nominal values according to free by selectable optimizing criteria, such as for example minimum total energy consumption or maximum throughput.

The invention is further illustrated with reference to the drawing schematically showing embodiments of the invention.

In the drawing

Figure 2:
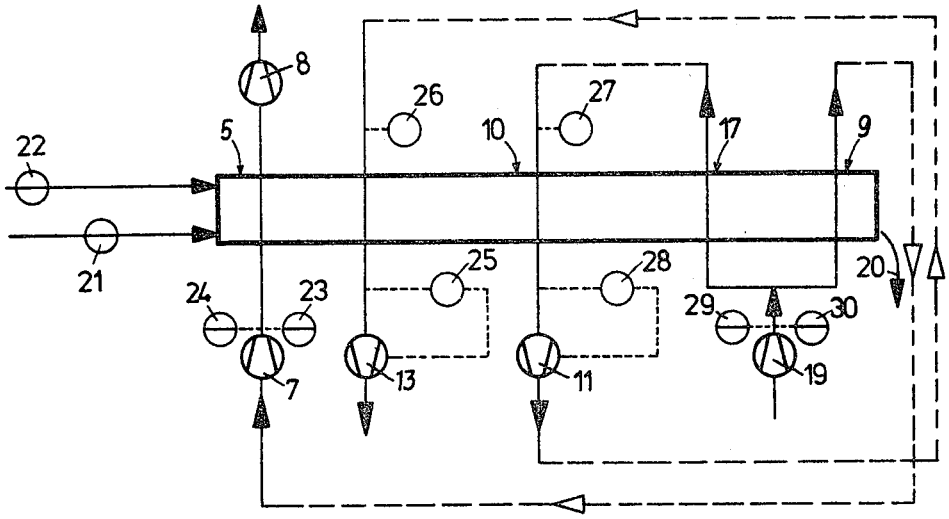

FIG. 1 is a schematic representation of a travelling grate plant,

FIG. 2 schematically shows a control according to the known art and

Figure 3:
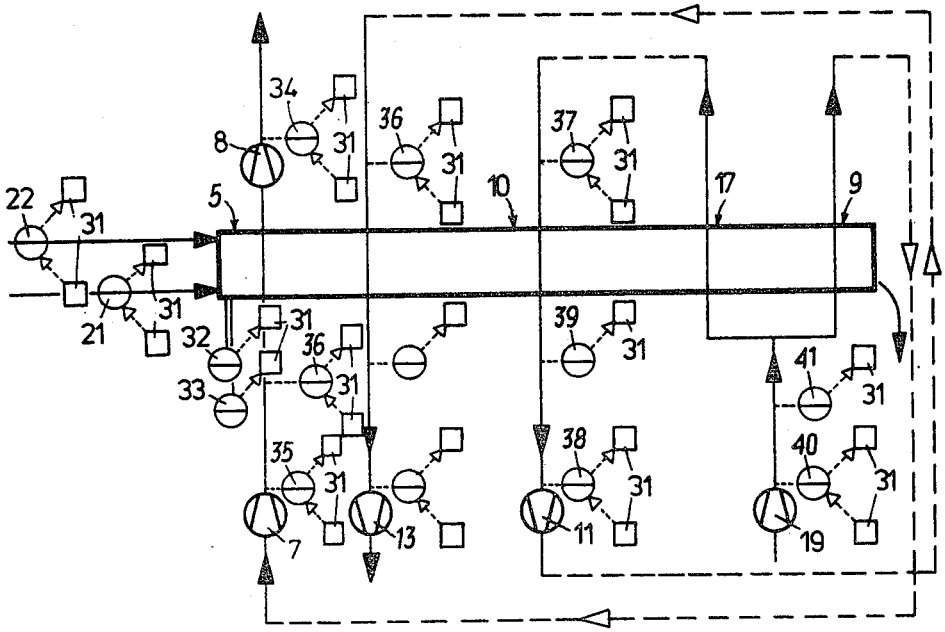

FIG. 3 schematically illustrates a monitoring process according to the invention.

FIG. 1 shows a travelling grate plant 1, onto the travelling grate 3 of which green pellets produced in a pelletizing equipment not shown are supplied by a conveyor means 2. A thin layer of calcined pellets is previously supplied to the travelling grate at 4. Within the pressurized drying zone 5, air coming from the last cooling zone 6 is blown through the layer of pellets from below in upward direction by means of the blower 7 for the pressurized drying zone and removed by means of an effluent air blower 8. Within the succeeding suction drying zone 9, gas coming from the sintering zone 10 is blown through the layer of pellets from above in downward direction by means of the blast box recuperative blower 11. A blast box 12 is extending over the suction drying zone and the first portion of the sintering zone 10. A waste gas blower 13 is connected to this blast box 12.

Hot combustion gases are supplied to the sintering zone 10 via conduits 14 and removed via the blast boxes 12 and 15. The sintering zone 10 is followed by a post-sintering zone 16 and a first cooling zone 17. Below the cooling zones 6 and 17, a blast box 18 is provided into which a cooling air blower 19 is opening with its outlet end. The calcined pellets are discharged at 20 after having passed the second cooling zone 6.

FIG. 2 schematically illustrates the control of such a travelling grate plant according to the known art. 21 designates the control for the travelling speed of the travelling grate or conveyor belt and 22 designates the control of the amount or the weight, respectively, of the charge supplied. The controls shown maintain a constant height of for example 0.4 m of the layer of pellets, the height of the layer of pellets being for one fourth formed of a base layer of calcined pellets. Drying air is supplied to the pressurized drying zone 5 via the blower 7 for this pressurized drying zone and is subsequently removed by the waste gas blower 8. The temperature of the drying air is maintained at the desired value by means of a temperature regulator 23. The amount of air is controlled by means of the pressure regulator 24.

Effluent air from the second cooling zone 9 is supplied to the blower 7 for the pressurized drying zone so that the desired temperature being for example within the range of 200° to 280° C. can be adjusted in a simple manner.

The waste gas blower 13 connected with the blast box 12 shown in FIG. 1 is monitored by a control circuit 25 dependent on the temperature. The temperatures at the gas entry into this zone are maintained at a constant value by means of a temperature control 26. Constant values of temperature are controlled in an analogous manner by a regulator 27 at the area of the sintering zone 10, noting that the recuperative blower 11 associated with this sintering zone is again controlled by a regulator 29 dependent on the effluent gas temperature. The recuperative blower 11 feeds the waste gasses back into the area of suction drying zone where the temperature is maintained at a constant value by the regulator 26. The cooling air blower 19 is provided with a pressure control 29, in which case the temperature of the cooling air is measured at 30.

In FIG. 3 illustrating the monitoring process according to the invention, there is selected essentially the same representation as in FIG. 2 and equal parts are also provided with the same reference numeral. In contrast to the previously described control circuits according to FIG. 2, a nominal value for the control 22 of the amount of weight, respectively, of pellets supplied is pre-established by the process calculator 31 and the measured value obtained is fed back to the process calculator 31. The same applies in an analogous manner for the control 21 of the travelling speed of the travelling grate. Immediately after having charged the green pellets onto the travelling grate, the permeability of the layer of green pellets is measured by a schematically shown device 32 and the measured value obtained therein is fed to the process calculator 31. In the same manner, the humidity can be measured with a device 33 and the measured value obtained is equally fed to the process calculator 31. Based on the actual values for the sintering point as determined by the process calculator (the sintering point shall be reached at the end of the sintering zone 10), the waste air blower 8 is controlled according to the preselected nominal value for the pressure control 34. The blower 7 for the pressurized drying zone is equally subjected to a pressure control 35 in dependence on values calculated by the process calculator, noting that subsequently a temperature control is effected according to the preselected nominal values for the gas entering temperatures at 36 for the pressurized drying zone as well as for the suction drying zone. Temperature control in accordance with the nominal value pre-established by the process calculator for the sintering zone is schematically designated 37, the recuperative blower 11 associated with this sintering zone being subject to a pressure control 38 in accordance with the premise delivered by the process calculator. A temperature measuring device 39 is interconnected into the waste gas conduit leading to the recuperative blower 11 and the measured value delivered thereby is again brought at disposal of process calculator 31.

Finally also the cooling air blower 19 is subject to a pressure control 40 in accordance with the premise delivered by the process calculator, noting that the temperature of the cooling air will, as a rule, be room temperature. The temperature of the cooling air is again sensed at a measuring point 41 and the measured value obtained is supplied to the process calculator 31.

With the aid of the process calculator and based on a model in its turn based on physical-chemical laws any desired differentiated subdivision of the layer of pellets and of the gas stream into elements can be made, thereby considering the heat transfer by connection between layer of pellets and process gas. The monitoring process is also considering the maximum admissible temperature stress of the pellets, i.e. the burst point of the pellets, and also considers the drying process and the condensation phenomena, respectively, the oxydation of the pellets, the decomposition of carbonates and the formation of calcium ferrite. The model used by the process calculator is also considering the geometry and the temperature and the grain size distribution of the layer of pellets with respect to the pressure drop of the process gas flowing through the layer of pellets as well as the gas circuit consisting of blower, control valves and pipings and the characteristic curves of these constructional parts. For this purpose it is necessary to measure the permeability and the humidity of the layer of pellets when feeding the pellets or immediately after having fed the pellets to the sintering machine, because said both parameters represent the main disturbance quantities. By means of this model, an actual value for the sintering point is forecast by calculation based on quantities, such as temperature and pressure fields, permeability, humidity, throughput and travelling velocity of the travelling grate or conveyor belt, easily accessible by measurement and a feed forward control is effected by comparing calculated actual values to be expected with corresponding nominal values.

The control of the amount of gas transported by the waste gas blower and by the recuperative blower is changed over or transformed to a calculated nominal value of the pressure by the temperature being the command variable.

Thus there result arbitrarily adjustable optimizing criteria such as minimum fuel consumption, minimum consumption in electrical energy, minimum total consumption in energy and maximum throughput for selecting for the plant the conditions most favourable with respect to operation cost.

Spherical pellets are charged to the plant with an average diameter of for example approximately 10 mm and consist of pulverulent ore having a particle size of 3 to 8 μm, corresponding to a surface area of 1500 to 3500 $cm^2/g$. Based on this surface areas the heat transport and material transport is calculated under consideration of the evaporating water and the oxydation reactions and the pressure drop is calculated with consideration of the intrinsic properties of pellets, the air and the water. Furthermore the energy balance and the material balance for air and for the layer of pellets is established. The distribution of the amount of air along the length of the grate is iteratively established based on a calculation for the individual zones and on the pressure drop preselected for each zone as well as on the calculated temperature distribution.

The humidity content of the green pellets to be charged on the travelling grate can be measured either immediately after having been charged onto the travelling grate or be calculated from the amount of water added with consideration of the humidity content of the starting ores. As can be derived from FIG. 3, the permeability of the pellets is measured immediately after charging the pellets onto the travelling grate because the measured value obtained is particularly characteristic at this location and the measured value can be obtained at this position in a simple manner.

The term sintering point is used for that location on the travelling grate where the hot guses passing through the mixture to be sintered have heated the layer of the mixture to be sintered over its whole height to its sintering temperature. Instead of the term sintering point also the term through-burn point might be used.

What is claimed is:

1. Process for monitoring a pelletizing plant for green pellets of fine-grained ores, in which the humidity content of the green pellets is adjusted by adding water with consideration of the humidity content of the fine ores and humidified ores, together with optional additives, are charged to a travelling grate in an amount to form a layer and are hardened on the grate in a sintering zone by a heat treatment carried out by passing a process gas through the layer of pellets, said process gas having a process gas temperature and a process gas pressure, characterized in that the green pellets are charged onto the travelling grate and the permeability of the pellet layer is measured, in that the measured values for the permeability of the layer and a value for the humidity of the green pellets are supplied to a process calculator for monitoring the process on the basis of the process gas pressure, in that the sintering temperature is maintained constant, and in that the process is monitored by comparing the position of the sintering point on the travelling grate at the end of the sintering zone, as calculated on basis of the process gas pressure, with a nominal value for this position of the sintering point.

2. Process as claimed in claim 1, characterized in that the process gas temperatures are, in case any variations of the process gas pressure are surpassing limits existing for an existing plant, varied at the entrance of the layer of pellets such that there exists a consistency between the nominal temperature at the sintering point and the calculator temperature.

3. Process as claimed in claim 1, characterized in that the permeability of the layer of pellets is measured immediately after charging or during charging the green pellets onto the travelling grate.

4. A process as in claim 1 wherein process gas passes through the layer from a sintering zone into a blast box and then to a recuperative blower, the process including controlling the amount of gas supplied to the sintering zone by pre-establishing a nominal value for the blast box pressure and controlling the recuperative blower is dependence on the blast box pressure.

5. A process as in claim 1 wherein blowers are used to pass the process gas through the layer, the process including reducing the amount of green pellets charged to the travelling grate when the maximum admissible temperature load of the blowers is exceeded.

6. A process as in claim 1 wherein blowers are used to pass the process gas through the layer, the process including reducing the amount of green pellets charged to the travelling grate when the maximum admissible drying speed of the green pellets is exceeded.

* * * * *